US012472406B1

(12) United States Patent
Garbs et al.

(10) Patent No.: US 12,472,406 B1
(45) Date of Patent: Nov. 18, 2025

(54) GOLF CLUBHEAD WITH POWDER FILLED CAVITY

(71) Applicant: TWO-NINES GOLF COMPANY LLC, Cypress, TX (US)

(72) Inventors: Brett Garbs, Cypress, TX (US); Thomas Jason Mittner, Williamsville, NY (US)

(73) Assignee: TWO-NINES GOLF COMPANY LLC, Cypress, TX (US)

( * ) Notice: Subject to any disclaimer, the term of this patent is extended or adjusted under 35 U.S.C. 154(b) by 0 days.

(21) Appl. No.: 18/091,896

(22) Filed: Dec. 30, 2022

Related U.S. Application Data

(60) Provisional application No. 63/296,097, filed on Jan. 3, 2022.

(51) Int. Cl.
*A63B 53/04* (2015.01)
*A63B 102/32* (2015.01)

(52) U.S. Cl.
CPC ..... *A63B 53/0416* (2020.08); *A63B 53/047* (2013.01); *A63B 2053/0491* (2013.01); *A63B 2102/32* (2015.10)

(58) Field of Classification Search
CPC ... A63B 53/04; A63B 53/0466; A63B 53/047; A63B 53/0475; A63B 53/0487
See application file for complete search history.

(56) References Cited

U.S. PATENT DOCUMENTS 4,145,052 A * 3/1979 Janssen ..... A63B 60/00 473/338
4,803,023 A * 2/1989 Enomoto ..... A63B 53/0466 264/45.4
4,826,172 A * 5/1989 Antonious ..... A63B 53/04 473/350
5,154,425 A * 10/1992 Niskanen ..... C22C 32/00 473/342
5,312,106 A * 5/1994 Cook ..... A63B 60/02 473/336
5,658,207 A * 8/1997 Aizawa ..... A63B 53/0466 473/328
6,306,048 B1 * 10/2001 McCabe ..... A63B 53/04 473/335

(Continued)

FOREIGN PATENT DOCUMENTS

JP 08238340 A * 9/1996
JP 10146404 A * 6/1998

(Continued)

*Primary Examiner* — Alvin A Hunter
(74) *Attorney, Agent, or Firm* — Rutan & Tucker LLP; Kyle St. James

(57) ABSTRACT

A golf clubhead including a powder filled cavity configured for improving sound and feel of the golf club while striking the golf ball. The powder may include the frame material of the clubhead in a powdered form. A manufacturing process of the clubhead may include a material additive process. Filling the cavity with powder may be performed by powder dispensing equipment of the material additive manufacturing process. The clubhead may include weighting ports for defining a balance point or moment of inertia of the clubhead. The powder may have a density greater than the frame material of the clubhead.

20 Claims, 5 Drawing Sheets

(56) References Cited

U.S. PATENT DOCUMENTS

| | | | | |
|---|---|---|---|---|
| 6,533,679 | B1 * | 3/2003 | McCabe | A63B 60/02 473/335 |
| 6,648,774 | B1 * | 11/2003 | Lee | A63B 53/04 473/347 |
| 6,855,067 | B2 * | 2/2005 | Solheim | A63B 53/0466 473/339 |
| 10,874,921 | B2 * | 12/2020 | Parsons | A63B 53/047 |
| 11,383,139 | B2 * | 7/2022 | Finn | B29C 45/1671 |
| 2010/0298065 | A1 * | 11/2010 | Soracco | A63B 53/04 419/1 |
| 2015/0306475 | A1 * | 10/2015 | Curtis | A63B 53/06 473/345 |

FOREIGN PATENT DOCUMENTS

| | | | | |
|---|---|---|---|---|
| JP | 2007130317 | A * | 5/2007 | |
| WO | WO-9956898 | A1 * | 11/1999 | B22F 3/16 |

* cited by examiner

GOLF CLUBHEAD WITH POWDER FILLED CAVITY

CROSS-REFERENCE TO RELATED APPLICATIONS

This application claims the benefit of priority on U.S. Provisional Application No. 63/296,097, titled, "Golf Apparatus Having a Fully Encapsulated, Powder-Filled and Systems and Methods of Manufacturing," and filed Jan. 3, 2022, the entire contents of which is incorporated by reference.

BACKGROUND

Sound is a key part of a user's experience when striking a golf ball. In some instances a softer sound of the clubhead striking the ball may enhance the golfing experience and can give a sense of confidence to the golfer in relation to a more centered ball strike. Feel is also a very important aspect of the user experience when striking a golf ball. While feel can be subjective and unique to the individual user, feel can be described as the physical sensation of contacting (e.g., striking) a golf ball whereby the user experiences a return in the form of both sound and tactile feedback from the golf shot. Traditional golf clubs in use today are typically that of a solid body design and use conventional manufacturing processes such as forgings, castings, and computer numerical control (CNC) milling. As such, the benefits of softer sound and feel are limited. Disclosed herein are clubheads and methods of manufacturing clubheads that improve the sound and feel of striking the golf ball.

SUMMARY

Disclosed herein is a golf clubhead that according to some embodiments, includes a frame defining a cavity and a powder disposed within the cavity, where the powder completely fills the cavity.

In some embodiments, the frame defines a clubface extending across a front side of the clubhead, where the clubface is configured to contact a golf ball during use, and where a front wall of the cavity defines at least a portion of the clubface.

In some embodiments, a clubhead manufacturing process includes forming the frame via a material additive manufacturing process, where the frame includes a frame material in a sintered state. In some embodiments, the frame material includes one of a 316L or a 17-4 PH stainless steel. In some embodiments, the powder includes the frame material in a non-sintered state.

In some embodiments, the material additive manufacturing process includes (i) dispensing a first portion of the frame material in a non-sintered state onto a frame portion via a material dispensing device of an additive manufacturing equipment, (ii) sintering the first portion of the frame material to form the cavity, and (iii) dispensing a second portion of the frame material in the non-sintered state into the cavity via the material dispensing device.

In some embodiments, the material additive manufacturing process includes sintering a top layer of the second portion of the frame material within the cavity to transition the cavity from an open state to a closed state.

In some embodiments, the clubhead manufacturing process includes (i) forming the frame via the material additive manufacturing process, where the frame includes the cavity in an open state; (ii) filling the cavity with the powder; and (iii) coupling a cap to the frame to transition the cavity from the open state to a closed state.

In some embodiments, the density of the powder is greater than the density of the frame material, and in some embodiments, the powder includes tungsten.

In some embodiments, the frame defines at least a second cavity having a second powder disposed therein.

In some embodiments, the frame includes a hosel cavity formed via the material additive manufacturing process, and in some embodiments, the golf clubhead further includes a hosel coupled with the frame via the hosel cavity, where the hosel is configured to couple with a golf club shaft.

In some embodiments, the golf clubhead further includes a number of weight cavities having a weighting material disposed therein, where the weight cavities, including internal threads, are formed within the frame via the material additive manufacturing process, and where each weight cavity is closed via a threaded cap.

Also disclosed herein is a method of manufacturing a clubhead of a golf club that, according to some embodiments, includes (i) manufacturing a frame of the clubhead via a material additive manufacturing process that includes dispensing a frame material in a powdered form; (ii) forming a cavity within the frame via the material additive manufacturing process; (iii) filling the cavity with a powdered metal; and (iv) closing the cavity.

In some embodiments of the method, filling the cavity includes dispensing the frame material into the cavity via the material additive manufacturing process.

In some embodiments of the method, closing the cavity includes sintering a top layer of the powder within the cavity to form a top wall of the cavity.

In some embodiments of the method, manufacturing the frame includes (i) forming a clubface, where the clubface is configured to contact a golf ball during use, and (ii) forming the cavity adjacent the clubface such that a front wall of the cavity defines at least a portion of the clubface.

In some embodiments, the method further includes (i) manufacturing a hosel via the material additive manufacturing process, (ii) forming a hosel cavity within the frame via the material additive manufacturing process, and (iii) coupling the hosel to the frame via the hosel cavity.

In some embodiments, the method further includes (i) forming a number weighting cavities within the frame via the material additive manufacturing process, each weighting cavity having internal threads; (ii) placing a weighting material within each weighting cavity; and (iii) closing each weighting cavity with a threaded cap.

These and other features of the concepts provided herein will become more apparent to those of skill in the art in view of the accompanying drawings and following description, which describe particular embodiments of such concepts in greater detail.

DRAWINGS

DESCRIPTION

Figure 1:
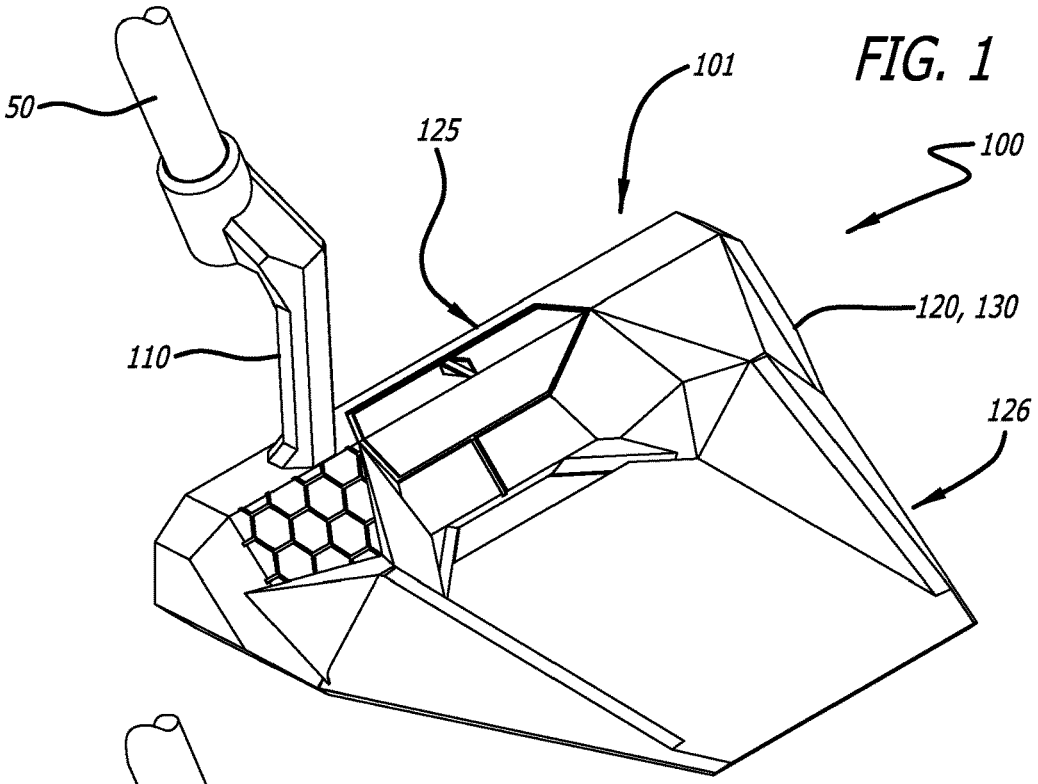
FIG. 1 illustrates a top perspective view of a clubhead for golf club, in accordance with some embodiments.

Before some particular embodiments are disclosed in greater detail, it should be understood that the particular embodiments disclosed herein do not limit the scope of the concepts provided herein. It should also be understood that a particular embodiment disclosed herein can have features that can be readily separated from the particular embodiment and optionally combined with or substituted for features of any of a number of other embodiments disclosed herein.

Regarding terms used herein, it should also be understood the terms are for the purpose of describing some particular embodiments, and the terms do not limit the scope of the concepts provided herein. Ordinal numbers (e.g., first, second, third, etc.) are generally used to distinguish or identify different features or steps in a group of features or steps, and do not supply a serial or numerical limitation. For example, "first," "second," and "third" features or steps need not necessarily appear in that order, and the particular embodiments including such features or steps need not necessarily be limited to the three features or steps. Labels such as "left," "right," "top," "bottom," "front," "back," and the like are used for convenience and are not intended to imply, for example, any particular fixed location, orientation, or direction. Instead, such labels are used to reflect, for example, relative location, orientation, or directions. Singular forms of "a," "an," and "the" include plural references unless the context clearly dictates otherwise.

Any methods disclosed herein include one or more steps or actions for performing the described method. The method steps and/or actions may be interchanged with one another. In other words, unless a specific order of steps or actions is required for proper operation of the embodiment, the order and/or use of specific steps and/or actions may be modified. Moreover, sub-routines or only a portion of a method described herein may be a separate method within the scope of this disclosure. Stated otherwise, some methods may include only a portion of the steps described in a more detailed method. Additionally, all embodiments disclosed herein are combinable and/or interchangeable unless stated otherwise or such combination or interchange would be contrary to the stated operability of either embodiment.

Unless defined otherwise, all technical and scientific terms used herein have the same meaning as commonly understood by those of ordinary skill in the art.

Disclosed herein below are golf clubheads that incorporate a powder-filled cavity therein. One benefit of the powder-filled cavity is sound attenuation including harmonics. As the metallic powder may have a lower density than a solid or sintered metal, the lower density of the powder filled cavity may dampen sound to a degree as sounds waves are transferred through the golf club. As such, a softer and more appealing sound may be generated when striking the golf ball. Sound is a key part of a user's experience when striking a golf ball, so this softer sound may enhance the golfing experience and can give a sense of confidence to the golfer in relation to a more centered ball strike.

Another benefit may be improved tactile feedback. Similar to sound, feel is also a very important aspect of the user experience when striking a golf ball. While feel can be subjective and unique to the individual user, feel can be described as the physical sensation of contacting (e.g., striking) a golf ball whereby the user experiences a return in the form of both sound and tactile feedback from the golf shot. Embodiments of the golf apparatuses disclosed herein deliver to the user improved audible and tactile feedback. Specifically, the powder-filled cavity may decrease the amount of vibration that propagates up the shaft to the handle, which results in a decrease in the amount of vibration felt by the hands of the golfer.

A further benefit may include improved clubhead weighting. In some embodiments herein, the cavity may be selectively filled with different types of powders of differing densities to adjust the center of gravity or balance point as desired by a specific golfer. For instance, a higher density material can be used towards the top of the clubhead to move the center of gravity upwards or conversely, a higher density material can be used towards the bottom of the clubhead to move the center of gravity down.

A specific benefit powder-filled cavity may include reduced "ball hop" during putting of the golf ball. In some embodiments disclosed herein, a putter head having powder-filled cavity may produce a trajectory of the golf ball such that there is less "ball hop" and the golf ball is in contact with the hitting surface, or ground, for a longer duration of time when compared with current putters on the market. By remaining in contact with the hitting surface or ground for an increased duration of impact, there is a resultant effect with a higher level of accuracy on the line taken by the golfer's desired path.

FIG. 1 illustrates a top perspective view of a clubhead 100 for a golf club. The clubhead 100 is configured to couple with a golf club shaft 50. In the illustrated embodiment, the clubhead 100 is a head for a putter. However, the clubhead 100 may be a clubhead for an iron or any other type of golf club. The clubhead 100 generally includes a clubface 125 extending along a front side 101 of the clubhead 100, where the clubface 125 is configured to contact a golf ball during use. In some embodiments, the clubhead 100 may include a rearward extension, such as the exemplary rearward extension 126 as shown. In some embodiments, the rearward extension 126 may be a separate component coupled with the frame 120 and in some embodiments, the rearward extension 126 may be chosen from a plurality optional reward extensions. In the illustrated embodiment, the clubhead 100 includes a frame 120 formed of a material 130. The clubhead 100 further includes a hosel 110 extending upward away from the frame 120, where the hosel 110 is configured to couple with the shaft 50. In other embodiments, the frame 120 may be configured to couple with the shaft 50 directly, i.e., the hosel 110 may be omitted.

Figure 2:
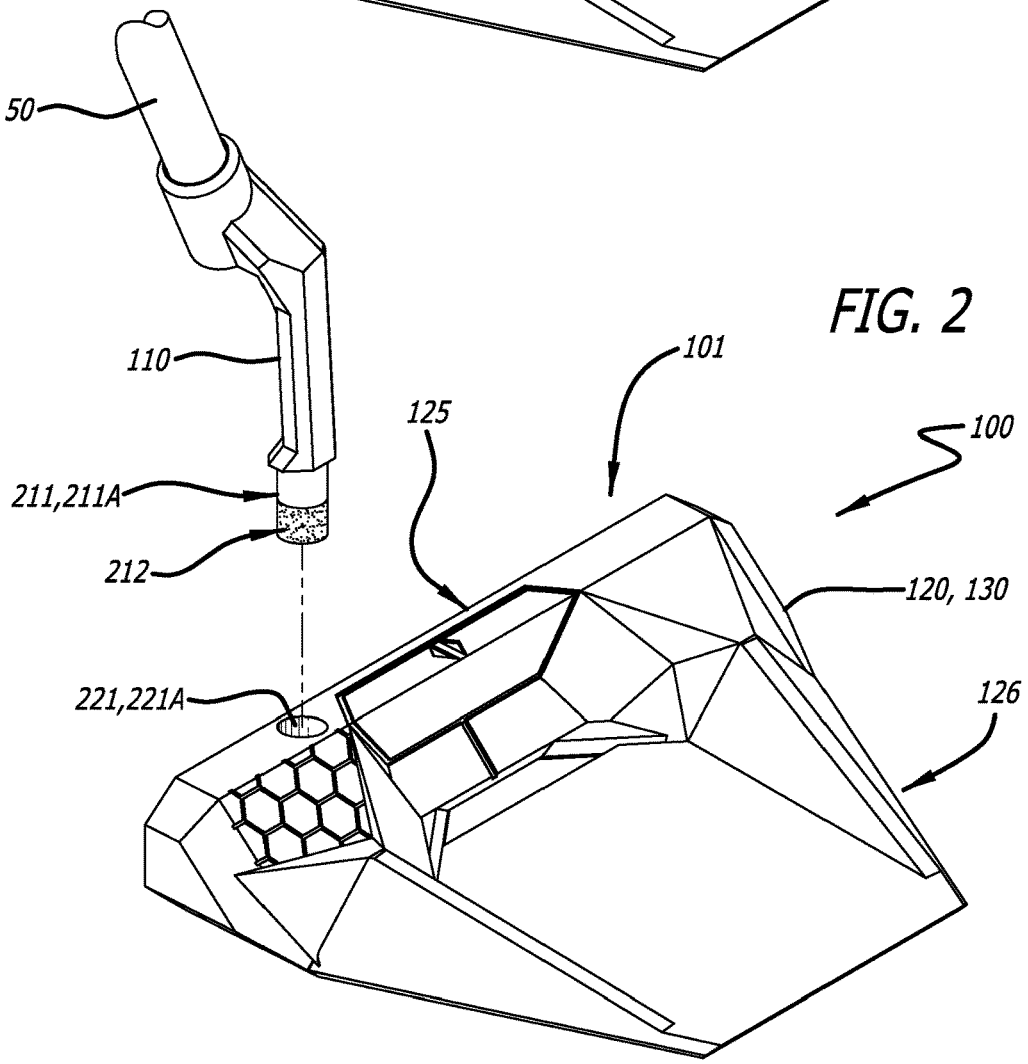
FIG. 2 illustrates an exploded top perspective view of a clubhead of FIG. 1, in accordance with some embodiments.

FIG. 2 illustrates an exploded view of the clubhead 100, where the hosel 110 is separated from the frame 120. The frame 120 includes a hosel cavity 221 and the hosel 110 includes a hosel post 211 configured for insertion into the hosel cavity 221. The hosel post 211 may be fixedly attached to the hosel cavity 221 via an adhesive 212. In some embodiments, the hosel post 211 and the hosel cavity 221 may include a cross-sectional shape 211A, and corresponding polygonal cross-sectional shape 221A, respectively, such as a polygonal shape, for example, so as to fix an orientation (rotational position) of the hosel 110 with respect to the frame 120.

In the illustrated embodiment, the frame 120 is manufactured via a material additive manufacturing process, such as 3D printing, for example. As such, various features of the frame 120 may be formed via the material additive manufacturing process. In other words, certain features of the frame 120 which may be typically formed via a material removal process (e.g., machining) may be formed directly via the material additive manufacturing process. Furthermore, some features of the frame 120 may be incompatible with other forms of clubhead manufacturing, such as casting and machining, for example. In the illustrated embodiment, the material additive manufacturing process may include dispensing a powder (i.e., the frame material 130 in a powdered state) as a first step and sintering (or adding a binding agent to) the dispensed powder as a second step. In the illustrated embodiment, the frame material 130 includes a 316L or 17-4 PH stainless steel. In other embodiments, the frame material 130 may include any other material suitable for a clubhead, such as carbon steel, other forms of stainless steel, or an alloy, for example.

In other embodiments, the frame 120 may be formed via a casting and/or milling manufacturing process. In such embodiments, the frame 120 may be cast (e.g., investment cast) or milled out of the frame material 130.

Figure 3:
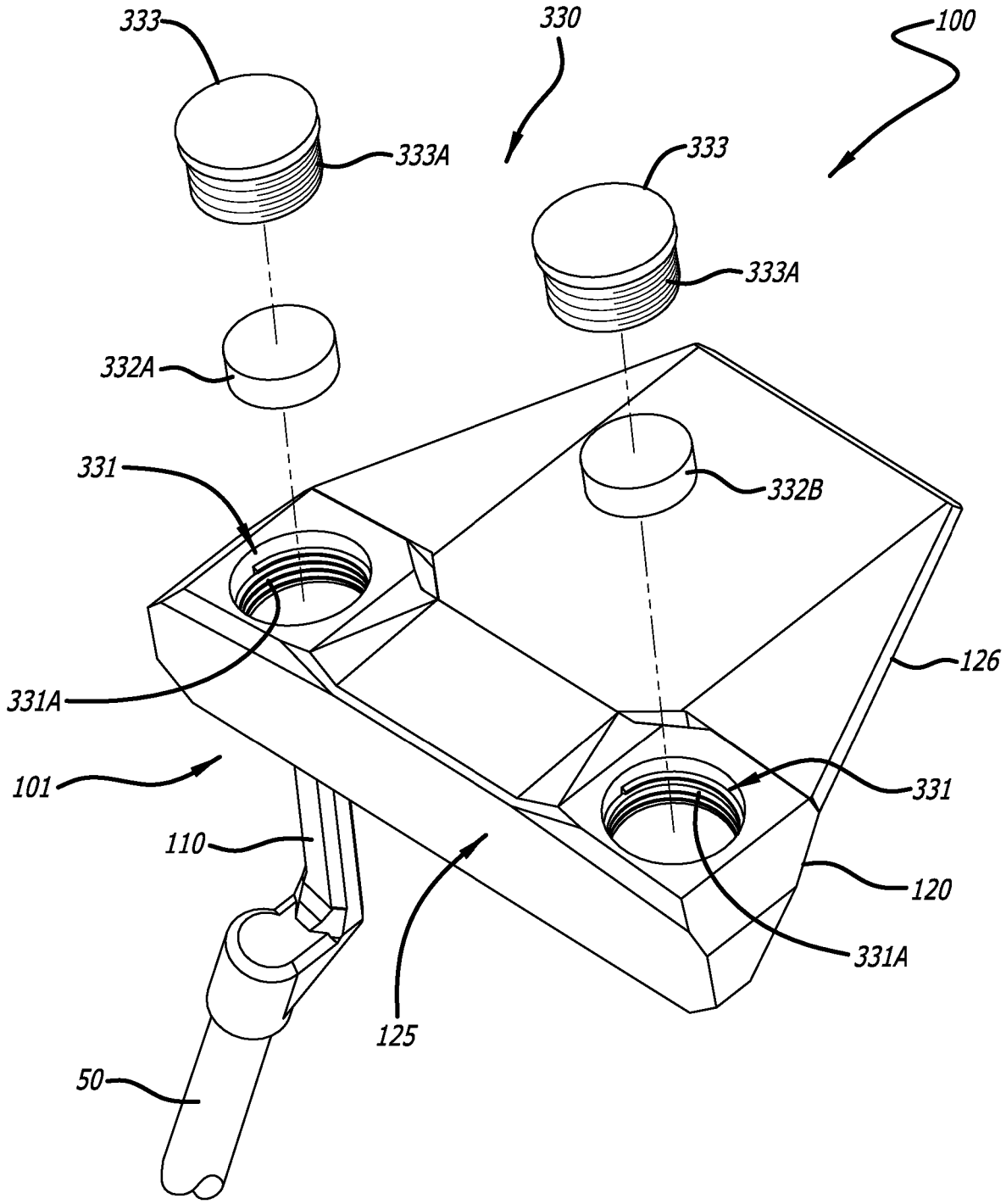
FIG. 3 illustrates an exploded bottom perspective view of a clubhead of FIG. 1, in accordance with some embodiments.

FIG. 3 illustrates a bottom perspective view of the clubhead 100, according to some embodiments. In some embodiments, the clubhead 100 may include a weighting system 330. The weighting system 330 may be configured to define and/or adjust a total weight of the clubhead 100 and/or a weight distribution of the clubhead 100. More specifically, the weighting system 330 may configured to define and/or adjust a moment of inertia (MOI) and/or a balance point of the clubhead 100. The weighting system 330 includes a number (e.g., two, three or more) of weighting cavities 331, where each weighting cavity 331 is configured to receive a weight (or weighting material) therein, such as the weights 332A, 332B as illustrated. In some embodiments, the weight 332A may the different from the weight 332B so as to define a balance point for the clubhead 100. In some embodiments, the weights 332A, 332B may be defined and installed during the clubhead manufacturing process. In other embodiments, the clubhead 100 may be provided without the weights 332A, 332B installed so that the user may install the weights 332A, 332B. In some embodiments, the weights 332A, 332B may be chosen from a plurality of weights suitable for placement within the weighting cavities 331 according to user preference.

The weighting system 330 may further include weighting cavity caps 333 configured for closing the weighting cavities 331 and securing the weights 332A, 332B therein. In some embodiments, the weighting cavity caps 333 may include external threads 333A that correspond to internal threads 331A of the weighting cavities 331. In the illustrated embodiment, the weighting cavities 331 may be formed directly via the material additive manufacturing process of the frame 120. Similarly, in some embodiments, the internal threads 331A may be formed directly via the material additive manufacturing process. In still other embodiments, the external threads 333A and the internal threads 331A may be omitted. In such embodiments, the weighting cavity caps 333 may be attached to the weighting cavities 331 via an adhesive or any other suitable attachment method.

Figure 5:
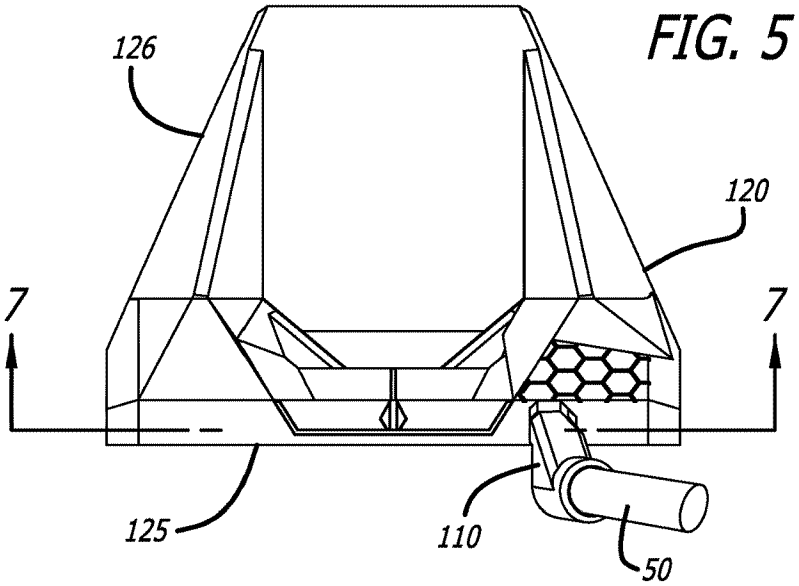
FIG. 5 is a top view of the clubhead, in accordance with some embodiments.
Figure 4:
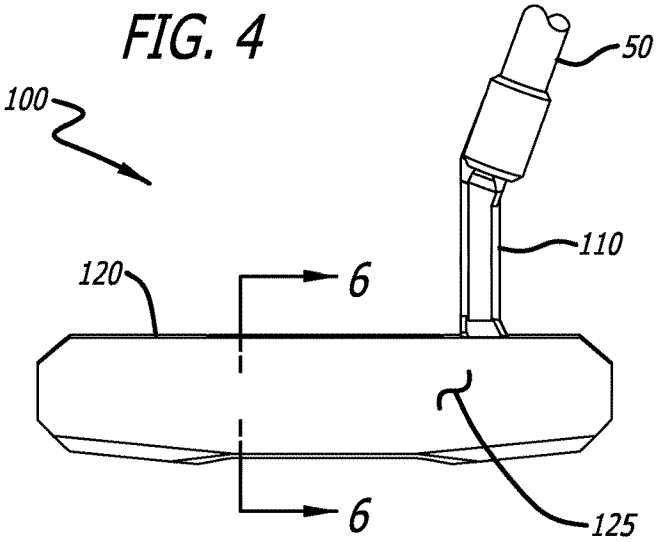
FIG. 4 is a front view of the clubhead of FIG. 1, in accordance with some embodiments.
Figure 6:
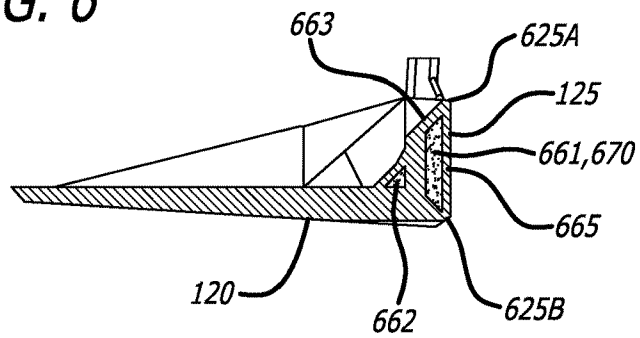
FIG. 6 is a cross-sectional side view of the clubhead 100 cut along the sectioning line 6-6 of FIG. 4, in accordance with some embodiments.

FIG. 4 is a front view of the clubhead 100 and FIG. 5 is a top view of the clubhead 100, each showing the frame the 120, the clubface 125, and the hosel 110. FIG. 6 is a cross-sectional side view of the clubhead 100 cut along the sectioning line 6-6 of FIG. 4 and FIG. 7 is a cross-sectional front view of the clubhead 100 cut along the sectioning line 7-7 of FIG. 5.

Referring to FIG. 6, the frame 120 includes a cavity 661 having a powder 670 disposed therein such that the power 670 fills the cavity 661. In the illustrated embodiment, the cavity 661 is located adjacent the clubface 125 such that the cavity 661 and the clubface 125 share a front wall 665. In some embodiments, the cavity 661 may extend substantially between a top 625A and a bottom 625B of the clubface 125. In some embodiments, the frame 120 may include at least one additional cavity 662 configured to contain a powder, such as the powder 670, for example. In some embodiments, the powder 670 includes the frame material 130 in the powdered state. As such, a top layer of the powder 670 within the cavity 661 may be sintered to define a top wall 663 of the cavity 661. In short, forming the frame 120 and filling the cavity 661 with the powder 670 may be performed via a single manufacturing process, i.e., 3D printing.

Figure 7:
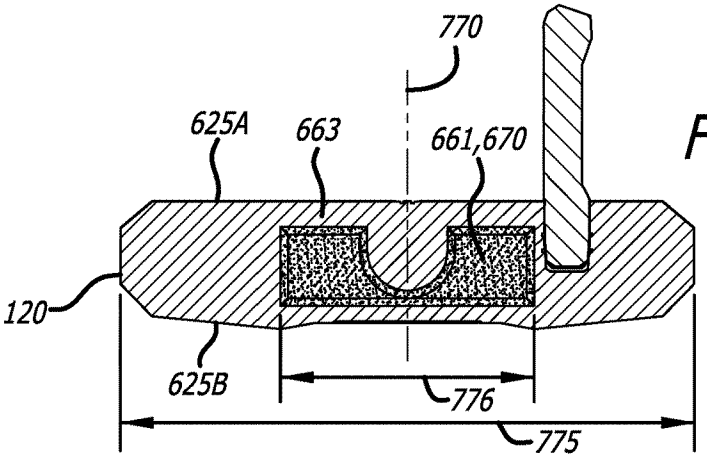
FIG. 7 is a cross-sectional front view of the clubhead cut along the sectioning line 7-7 of FIG. 5, in accordance with some embodiments.

Referring to FIG. 7, the cavity 661 extends longitudinally along a portion of the clubface 125 (shown cut away in FIG. 7). As shown, the cavity 661 includes a length 776 and the frame 120 includes length 775. The length 776 may constitute a substantial portion of the length 775. For example, the length 776 may be at least 30 percent, 40 percent, 50 percent, 60 percent, 70 percent or more of the length 775. In some embodiments, the cavity 661 may be symmetrically disposed about a balance point 770 (e.g., a center of gravity) of the clubhead 100. The cavity 661 may take a shape so as to define a desired distribution of the powder 670 with respect to the clubface 125 and/or the balance point 770.

Figure 8:
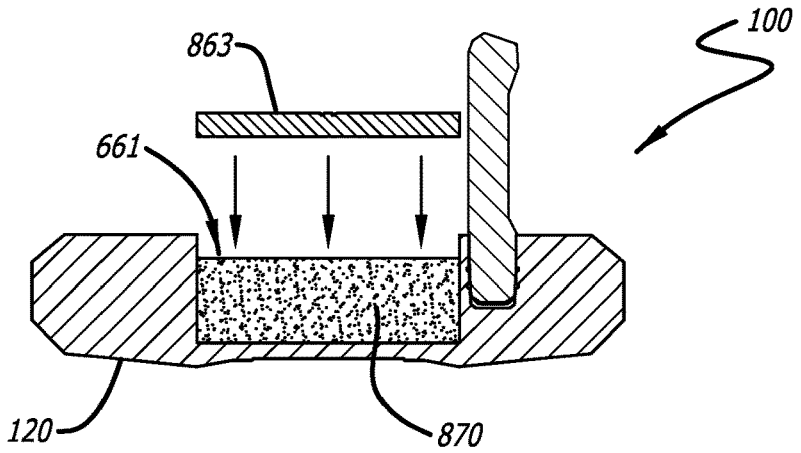
FIG. 8 is front cross-sectional view similar to FIG. 5 showing another embodiment of the clubhead including a cap, in accordance with some embodiments.

FIG. 8 is a cross-sectional view of the clubhead 100 illustrating another embodiment of the clubhead 100. The frame 120 includes the cavity 661 having a powder 870 dispensed therein such that the powder 870 fills the cavity 661. According to this embodiment, the frame 120 including the cavity 661 is formed leaving the cavity 661 unfilled and open at the top. The powder 870 dispensed with the cavity 661 after the frame 120 is formed. After the cavity 661 is filled with the powder 870, a cap 863 is attached to the frame 120 so as to cover the cavity 661 and to seal the powder 870 within the cavity 661. In some embodiments, the powder 870 may include the frame material 130 in the powdered state. As such, a density of the powder 870 may be substantially the same as a density of the frame material 130. In other embodiments, the powder 870 may be different from the frame material 130. A such, the density of the powder 870 may be different than the density of the frame material 130, such as greater than the density of the frame material 130, for example. In some embodiments, the powder 870 may include more than one powder, such as two powders that have different densities, for example. In some embodiments, the powder 870 may include tungsten having a weight between about 10 and 50 grams, between about 20 and 40 grams or a weight of about 30 grams.

Figure 9:
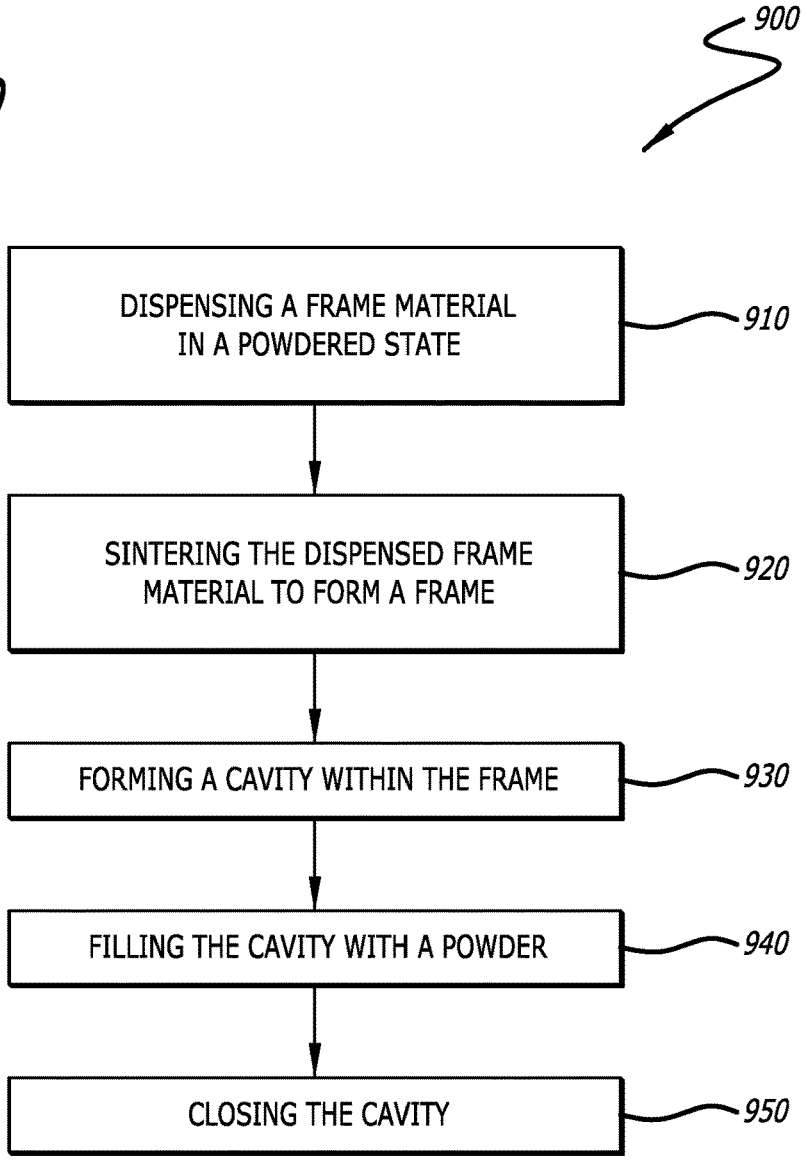
FIG. 9 is a block diagram of a manufacturing process of the clubhead, in accordance with some embodiments.

FIG. 9 illustrates a block diagram of a manufacturing process of the clubhead 100. The method 900 of manufacturing the clubhead 100, including the material additive manufacturing process, may include all or any subset of the following steps, actions or processes. The method 900 may include dispensing the frame material 130 in a powdered state (block 910) and thereafter sintering the dispensed frame material (block 920). The steps 910 and 920 may be repeated several times to create the frame 120 via layers of the frame material 130. In other words, the frame material 130 may be dispensed and sintered according to layers atop one another such that the frame 120 is created (i.e., grown) upward, such as from the bottom 625B of the clubface 125 to the top 625A of the clubface, for example. As may be recognized by one of ordinary skill, in other embodiments, the frame 120 may be grown or formed in a direction other than from the bottom 625B of the clubface 125 to the top 625A of the clubface.

The method 900 may include forming the cavity 661 within the frame 120 (block 930) via the material additive manufacturing process. More specifically, the walls surrounding the cavity, such as the front wall 665 may be formed via the material additive manufacturing process. In some embodiments of the method 900, forming the cavity 661 includes forming the cavity adjacent the clubface 125 such that the front wall 665 of the cavity 661 defines at least a portion of the clubface 125.

The method 900 may include filling the cavity with a powdered metal (block 940). In some embodiments, the powered metal may include the frame material 130 in the powered state. In other embodiments, the powered metal may include a metal other than the frame material 130 in the powered state, such as a tungsten powder, for example.

In some embodiments, filling the cavity 661 includes dispensing the frame material 130 into the cavity 661 via the material additive manufacturing process. For example, filling the cavity 661 may include dispensing the frame material 130 into the cavity 661 via dispensing equipment of the material additive manufacturing process. In other embodiments, filling the cavity 661 includes dispensing a metallic powder different from the frame material 130 into the cavity 661 via a dispensing device separate from the dispensing equipment of the material additive manufacturing process.

The method 900 may include closing the cavity 661 (block 950). In some embodiments of the method 900, closing the cavity 661 includes sintering a top layer of the frame material 130 within the cavity 661 to form the top wall 663 of the cavity 661 such that the powdered metal is completed enclosed within the cavity 661 and completely fills the cavity 661. According to another embodiment of the method 900, closing the cavity 661 may include applying a cap 863 to the cavity 661 to sealably cover the cavity 661. In some embodiments, applying the cap 863 includes bonding the cap 863 to the frame 120 such that the cap 863 forms a seal over the cavity 661.

In some embodiments, the method 900 may include manufacturing the hosel 110 via the material additive manufacturing process. The method 900 may also include forming the hosel cavity 221 within the frame 120 via the material additive manufacturing process, and coupling the hosel 110 to the hosel cavity 221 of the frame 120.

In some embodiments, the method 900 may include forming the weighting cavities 331 including the internal threads 331A via the material additive manufacturing process. The method 900 may further include placing a weight (e.g., one of the weights 332A, 332B) within each weighting cavity 331 and closing each weighting cavity 331 with a weighting cavity cap 333.

Figure 10:
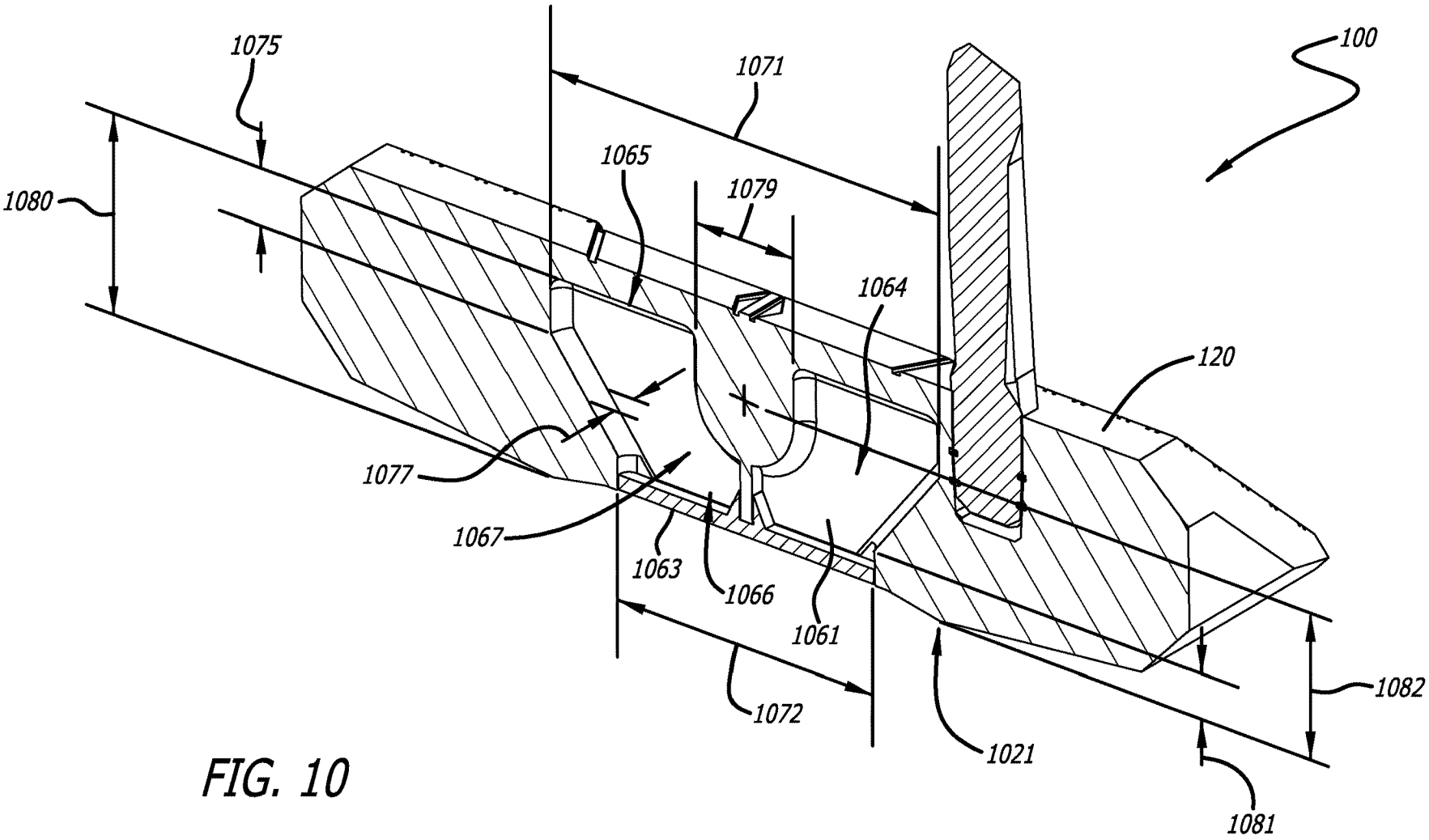
FIG. 10 is a front cross-sectional view showing another embodiment of the clubhead of FIG. 1, in accordance with some embodiments.

FIG. 10 illustrates another embodiment of the clubhead 100 giving various dimensional ranges for a cavity 1061, where the cavity 1061 may in certain respects resemble the features and functionality of the cavity 661. The cavity 1061 also includes an opening 1064 at a bottom side 1066 of the cavity 1061 and a cap 1062 covering the opening 1064.

The cavity 1061 defines a shape that in some respects may resemble an inverted trapezoid. The cavity 1061 defines a length 1071 of a top side 1065 of the cavity 1061 and a length 1072 of a bottom side 1066 of the cavity 1061, where the length 1072 may, according to some embodiments, also define a length of the opening 1064. The cavity 1061 further defines a (i) distance 1080 between a bottom side 1021 of the frame 120 and the top side 1065 of the cavity 1061, and (ii) a distance 1081 between the bottom side 1021 of the frame 120 and the bottom side 1066 of the cavity 1061. The cavity 1061 further defines a height 1075 of a vertical side portion of the cavity 1061 and a depth 1077 (i.e., thickness) of the cavity 1061. The top length 1071 may be less than about 1.5 inches, between about 1.5 and 2.5 inches, greater than about 2.5 inches, or about 2.0 inches. The bottom length 1072 may be between about 0.75 and 1.5 inches, or about 1.19 inches. The distance 1080 may be between about 0.75 and 1.25 inches or about 0.88 inches. The height 1081 of the vertical side portion 1075 may be between about "0" (zero) and 0.5 inches or about 0.25 inches. The depth 1090 may be between about 0.1 and 0.3 inches, or about 0.2 inches. The cavity 1061 contains a powder, (not shown but see the powder 870 of FIG. 8). In some embodiments, the powder may include tungsten having a weight between about 10 and 50 grams, between about 20 and 40 grams or a weight of about 30 grams.

In the illustrated embodiment, the cavity 1061 further includes a downward-directed inward protrusion 1067 having a radiused (i.e., semi-circular) bottom portion. The center of the radiused bottom portion is positioned a distance 1082 from the bottom side 1021. The radiused bottom portion defines a diameter of 1079. The distance 1082 may be between about 0.5 and 0.75 inches or about 0.63 inches, and the diameter of 1079 may be between about 0.25 and 0.75 inches or about 0.5 inches.

It is noted that in other embodiments, the inventive concept of incorporating metallic powder-filled cavities into apparatuses may be utilized to provide similar advantages with respect to other athletic equipment, e.g., goalposts (e.g., soccer, football, lacrosse), basketball rims, baseball or softball bats, tennis rackets, and the like.

While some particular embodiments have been disclosed herein, and while the particular embodiments have been disclosed in some detail, it is not the intention for the particular embodiments to limit the scope of the concepts provided herein. Additional adaptations and/or modifications can appear to those of ordinary skill in the art, and, in broader aspects, these adaptations and/or modifications are encompassed as well. Accordingly, departures may be made from the particular embodiments disclosed herein without departing from the scope of the concepts provided herein.

What is claimed is:

1. A golf clubhead, comprising:

a frame defining a clubface, a top wall, a first cavity, and a second cavity; and a powder disposed within each of the first cavity and the second cavity, wherein the top wall is sintered as a top layer of each of the first cavity and the second cavity following deposition of the powder within each of the first cavity and the second cavity, wherein a density of the powder is different than a density of frame material of the frame, wherein the frame material includes one of a 316L or a 17-4 PH stainless steel.

2. The golf clubhead according to claim 1, wherein the clubface extends across a front side of the clubhead, the clubface configured to contact a golf ball during use, and the golf clubhead further comprising:

a front wall of at least one of the first cavity or the second cavity defining at least a portion of the clubface.

3. The golf clubhead according to claim 1, wherein the density of the powder is less than a density of the frame material.

4. The golf clubhead according to claim 1, the powder includes at least the frame material in a non-sintered state.

5. The golf clubhead according to claim 1, wherein the clubhead is formed via a material additive manufacturing process.

6. The golf clubhead according to claim 1, wherein the powder includes a material different from the frame material, and the club head further comprises:

a cap attached to the frame, the cap sealably covering at least one of the first cavity or the second cavity.

7. The golf clubhead according to claim 1, wherein the density of the powder is greater than a density of the frame material.

8. The golf clubhead according to claim 1, wherein the powder includes tungsten.

9. The golf clubhead according to claim 1, wherein the second cavity includes a second powder disposed therein.

10. The golf clubhead according to claim 1, wherein the frame includes a hosel cavity, and wherein the golf clubhead further comprising:

a hosel coupled with the frame via the hosel cavity, the hosel configured to couple with a golf club shaft.

11. The golf clubhead according to claim 1, further comprising:

a number of weight cavities having a weighting material disposed therein, wherein each weight cavity is closed via a cap.

12. The golf clubhead according to claim 1, wherein the first cavity is located adjacent the clubface such that the first cavity and the clubface share a front wall.

13. A method of manufacturing a clubhead of a golf club, comprising:

manufacturing a frame of the clubhead via an additive manufacturing process, including dispensing a frame material in a powdered form, wherein the frame defines a clubface and a top wall;

forming a first cavity and a second within the frame via the additive manufacturing process;

disposing a second powder within the first cavity and the second cavity, wherein the top wall is sintered as a top layer of each of the first cavity and the second cavity following deposition of the powder within each of the first cavity and the second cavity;

closing the first cavity and the second cavity via the additive manufacturing process;

manufacturing a hosel via the material additive manufacturing process;

forming a hosel cavity within the frame via the material additive manufacturing process; and coupling the hosel to the frame via the hosel cavity.

14. The method according to claim 13, wherein disposing the second powder within the first cavity includes dispensing the powdered form of the frame material into the first cavity via the material additive manufacturing process.

15. The method according to claim 13, wherein manufacturing the frame includes:

forming the clubface configured to contact a golf ball during use, and forming the first cavity adjacent the clubface such that a front wall of at least one of the first cavity or the second cavity defines at least a portion of the clubface.

16. The method according to claim 13, further comprising:

forming a number of weighting cavities within the frame via the material additive manufacturing process;

placing a weighting material within each weighting cavity; and closing each weighting cavity with a cap.

17. The method according to claim 13, wherein the frame material includes one of a 316L or a 17-4 PH stainless steel.

18. A golf clubhead, comprising:

a frame defining a clubface, a top wall, a first cavity, and a second cavity; and a powder disposed within each of the first cavity and the second cavity, wherein the top wall is sintered as a top layer of each of the first cavity and the second cavity following deposition of the powder within each of the first cavity and the second cavity, wherein the clubhead is formed via a material additive manufacturing process, and wherein disposing the second powder within the first cavity includes dispensing a powdered form of a frame material into the first cavity via the material additive manufacturing process.

19. The golf clubhead according to claim 18, wherein the frame material includes one of a 316L or a 17-4 PH stainless steel.

20. The golf clubhead according to claim 18, wherein the clubface extends across a front side of the clubhead, the clubface configured to contact a golf ball during use, and the golf clubhead further comprising:

a front wall of at least one of the first cavity or the second cavity defining at least a portion of the clubface.

* * * * *